US005468095A

United States Patent [19]

Dawson

[11] Patent Number: 5,468,095

[45] Date of Patent: Nov. 21, 1995

[54] ADJUSTABLE CONCRETE ROD

[76] Inventor: Peter J. Dawson, 24835 Arnold Dr., Sonama, Calif. 95476

[21] Appl. No.: 158,382

[22] Filed: Nov. 29, 1993

[51] Int. Cl.[6] ..... E01C 19/12; E01C 19/22

[52] U.S. Cl. ..... 404/118; 404/119

[58] Field of Search ..... 404/96, 97, 118, 404/119, 120; 15/235.4, 235.8

[56] References Cited

U.S. PATENT DOCUMENTS

| | | | |
|---|---|---|---|
| 985,214 | 2/1911 | Shroyer . | |
| 1,817,687 | 8/1931 | Heltzel . | |
| 2,906,114 | 9/1959 | Buckley | 72/136 |
| 4,702,640 | 10/1987 | Allen | 404/96 X |
| 4,795,332 | 1/1989 | Davis | 425/60 |
| 4,913,582 | 4/1990 | Barrett | 404/119 |

FOREIGN PATENT DOCUMENTS

| | | | |
|---|---|---|---|
| 3608893 | 9/1987 | Germany | 404/118 |
| 4138011 | 5/1993 | Germany | 404/118 |

OTHER PUBLICATIONS

"Adjustable Strikeboard Gives Variable Curb Exposure", Concrete Highway Magazine, vol. 5, No. 4 (Jul.–Aug. 1921) p. 94.

*Primary Examiner*—Ramon S. Britts
*Assistant Examiner*—James A. Lisehora
*Attorney, Agent, or Firm*—David L. Baker; Rhodes & Ascolillo

[57] ABSTRACT

In a preferred embodiment, an adjustable concrete rod for leveling the surface of uncured concrete disposed within a concrete form, the adjustable concrete rod including: an elongate member having a lower edge for the engagement and leveling of the uncured concrete; handles extending outwardly from each end of the elongate member, the handles engaging upper edges of the concrete form, the handles being manually graspable to move the elongate member along the surface of the concrete, with the lower edge adjustably in contact therewith, while the handles are in engagement with upper edges of the concrete form; and a securing apparatus to permit selective lengthwise adjustment of the elongate member.

10 Claims, 3 Drawing Sheets

ADJUSTABLE CONCRETE ROD

BACKGROUND OF THE INVENTION

1. Field of the Invention

The present invention relates to construction techniques generally and, more particularly, but not by way of limitation, to a novel adjustable rod for leveling concrete.

2. Background Art

After concrete is poured, it is necessary to level and smooth it. This is typically accomplished by working a length of 2"×4" Douglas fir over the surface of the concrete until the desired degree of leveling is attained. While this method is generally satisfactory, it is often difficult to find straight wood of sufficient length, particularly when longer lengths are required.

There have been a number of devices developed for leveling and/or smoothing uncured construction materials, as seen in the following patents.

U.S. Pat. No. 985,214, issued Feb. 28, 1911, to Shroyer, describes a paving apparatus for spreading "top stuff" on uncured concrete, which apparatus includes a rectangular frame having a serrated blade at the lower horizontal member thereof to evenly distribute the top stuff as the blade is drawn across the uncured concrete. The length of the blade is adjustable by loosening and tightening bolts. The upper horizontal member is a telescoping tube which is selectively secured at a desired length by means of tightening a set screw.

U.S. Pat. No. 1,817,687, issued Aug. 4, 1931, to Heltzel, describes a belting device of the type in which a transversely reciprocating belt is used to smooth the surface of a concrete road under construction. The device includes a bowed frame to keep the belt taut.

U.S. Pat. No. 2,906,114, issued Sep. 29, 1959, to Buckey, describes a plasterer's tool which is used to finished restricted areas such as the area between trim surrounding a door opening and a closely spaced wall. The tool includes a bar which spans the door opening and a knife at the distal end of the bar to trim and smooth plaster placed over the restricted area. The bar comprises two side-by-side telescoping lengths of lumber held together by means of bands.

U.S. Pat. No. 4,795,332, issued Jan. 3, 1989, to Davis, describes a screed for leveling uncured concrete, which screed is pivotable about, and extendable from, an adjustable point on the concrete form.

U.S. Pat. No. 4,913,582, issued Apr. 3, 1990, to Barrett, describes an adjustable pipe screed support which provides vertical adjustments for the distal ends of parallel pipe screed supports. The screed itself is shown as being of fixed length.

Accordingly, it is a principal object of the present invention to provide a concrete rod to replace conventional wood concrete rods.

It is a further object of the invention to provide such a concrete rod that is adjustable in length.

It is an additional object of the invention to provide such a concrete rod that is economically manufactured.

It is another object of the invention to provide such a concrete rod that is easily used and cleaned.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, an adjustable concrete rod for leveling the surface of uncured concrete disposed within a concrete form, the adjustable concrete rod comprising: an elongate member having a lower edge for the engagement and leveling of the uncured concrete; handles extending outwardly from each end of the elongate member, the handles engaging upper edges of the concrete form, the handles being manually graspable to move the elongate member along the surface of the concrete, with the lower edge adjustably in contact therewith, while the handles are in engagement with the upper edges of the concrete form; and a securing means to permit selective lengthwise adjustment of the elongate member.

BRIEF DESCRIPTION OF THE DRAWINGS

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
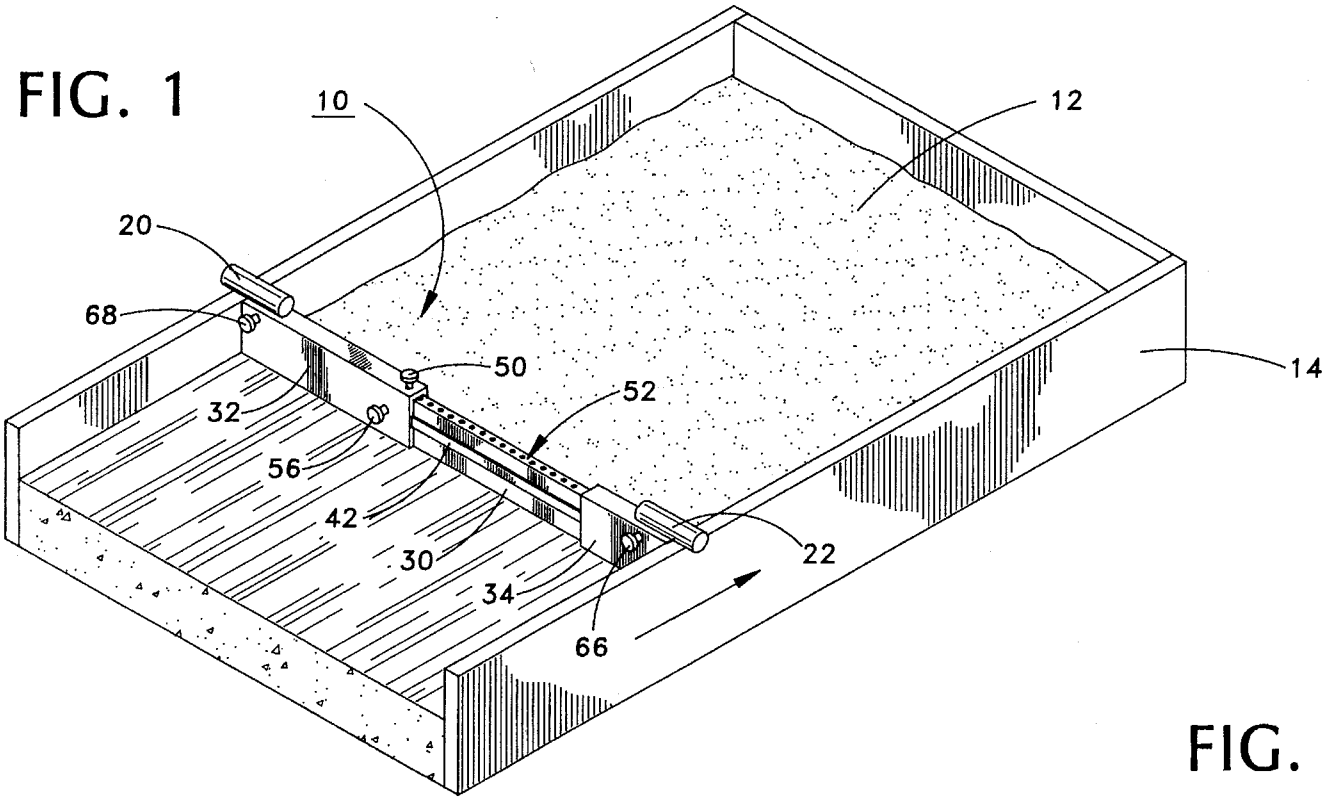
FIG. 1 is an isometric view showing a concrete rod according to the present invention in use.
Figure 2:
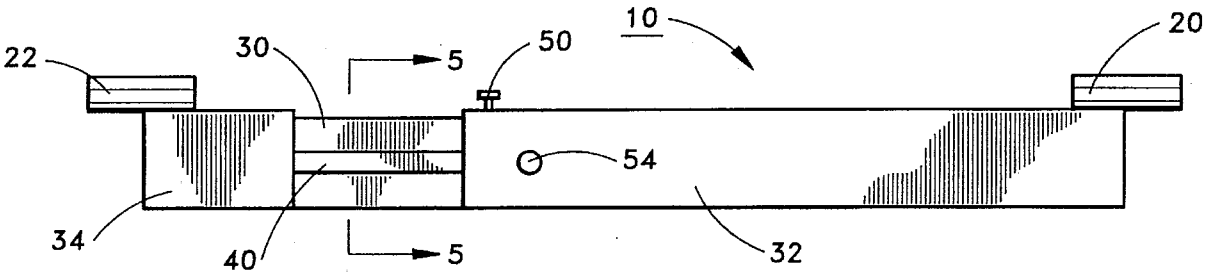
FIG. 2 is a side elevational view of the concrete rod.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a concrete rod, generally indicated by the reference numeral 10, constructed according to the present invention and shown being used to level uncured concrete 12 which has been poured into a concrete form 14. Leveling of concrete 12 is accomplished by manually grasping round endform handles 20 and 22 extending from the distal ends of concrete rod 10 and moving the rod in the direction indicated by the arrow on FIG. 1. The depth of the lower edge of concrete rod 10 in concrete form 14 and, therefore, the finished height of concrete 12 is fixed by the engagement of handles 20 and 22 with the upper edges of the sides of the concrete form at a selected height.

Figure 3:
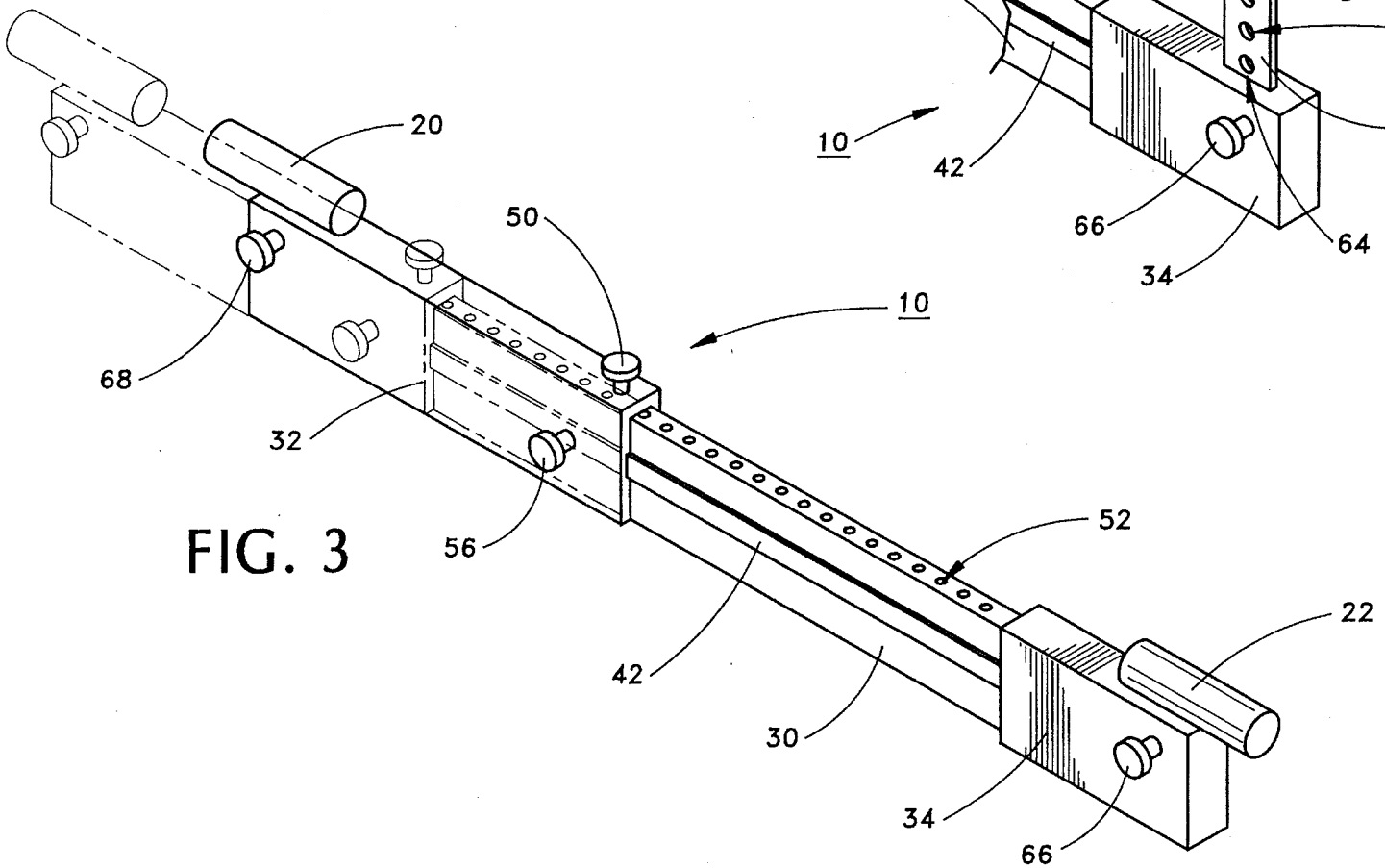
FIG. 3 is an isometric view of the concrete rod illustrating its horizontal adjustability.
Figure 5:
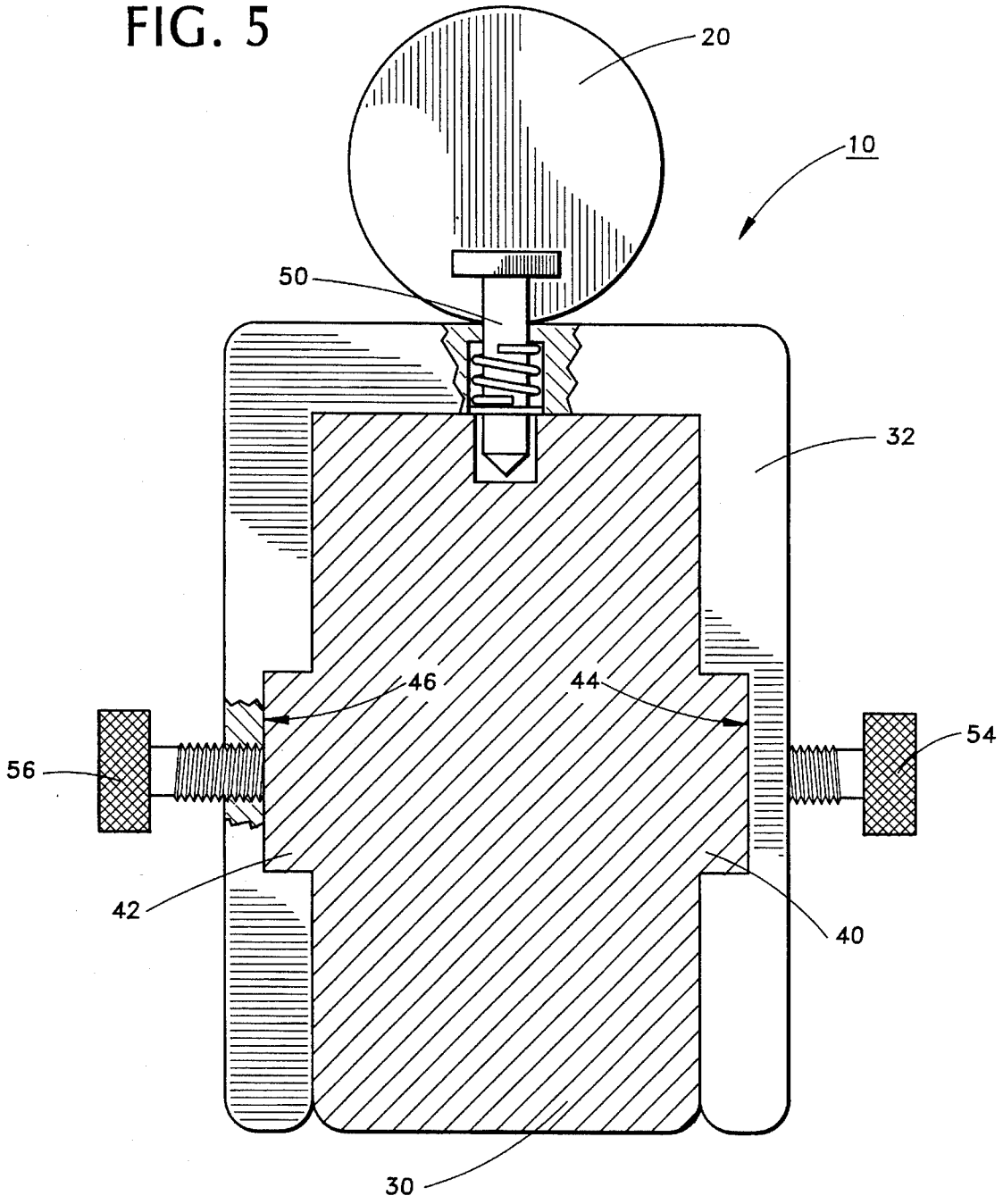
FIG. 5 is a cross-sectional view, partially cut-away, taken along line "5—5" of FIG. 2.

Reference should also be made now to FIGS. 2–5 and, especially, to FIG. 3. Concrete rod 10 includes a bar 30 having a proximal end inserted into the proximal end of a generally hollow housing 32 for relative axial movement therewith. An endform 34 is fixedly attached to the distal end of bar 30, at the top of which endform handle 22 is fixedly attached. Endform handle 20 is fixedly attached to the distal end of housing 32 as will be described in more detail below.

Relative rotational movement of bar 30 and housing 32 is substantially prevented (FIG. 5) by the full engagement of the top and side surfaces of bar 30 with the inner top and inner side surfaces of housing 32, and by the full engagement of outwardly extending flanges 40 and 42 with complementary channels 44 and 46, respectively, defined in the inner side surfaces of the housing 32.

A spring loaded pin 50 mounted in the top of housing 32 extends through the housing and into one of a plurality of holes, as at 52 (FIGS. 1,3, and 4), defined in the upper surface of bar 20. Set screws 54 and 56 extend through opposite side walls of housing 32 into complementary channels 44 and 46, respectively, and bear against the outer surfaces of flanges 40 and 42, respectively.

The length of concrete rod 10 is adjusted by loosening set screws 54 and 56, lifting pin 50 from one of holes 52, and sliding bar 30 in or out of housing 32 to the desired position. Then, pin 50 is released to selectively engage another one of holes 52, and finally set screws 54 and 56 are re-tightened.

Figure 4:
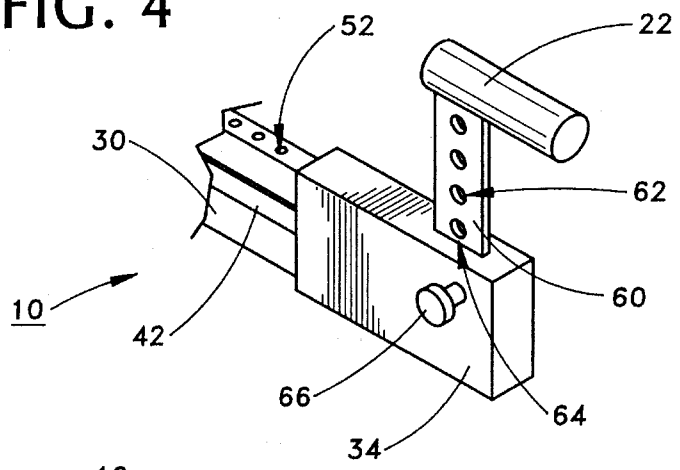
FIG. 4 is a detail illustrating the vertical adjustment of an end of the concrete rod.

Reference should now be made to FIG. 4. Endform handle 22 is fixedly attached to a vertical plate 60 having defined therethrough a plurality of vertically arranged holes, as at 62. Vertical plate 60 extends into a vertical slot 64 defined in endform 34 and is secured therein by means of a spring loaded pin 66 which extends between the side walls of the endform 34 and through a selected one of holes 62. Thus, the vertical distance between the lower edge of concrete rod 10 and endform handle 22 is selectively adjustable. A similar vertical adjustment of endform handle 20 is provided in the housing 32 which includes a spring loaded pin 68.

Concrete rod 10 may be economically constructed from a lightweight metal alloy. The lengths of bar 30 and housing 32 may be selected such that the overall length of the concrete rod may be between seven and twelve feet. To clean the concrete rod 10 after use, bar 30 may be removed from housing 32 and the various parts may be easily cleaned with water.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An adjustable concrete rod for leveling the surface of uncured concrete, said concrete being disposed within a concrete form, said adjustable concrete rod comprising:

(a) an elongate member having a lower edge for the engagement and leveling of said uncured concrete;

(b) a first handle extending outwardly from a proximal end of said elongate member, and (c) a second handle extending outwardly from a distal end of said elongate member, (d) said handles adapted to engage upper edges of a concrete form in which said uncured concrete is poured, (e) said handles being manually graspable to move said elongate member along said surface of said concrete, with said lower edge in contact therewith, while said handles are in engagement with said upper edges of said concrete form;

(f) a securing means to permit selective lengthwise adjustment of said elongate member;

(g) said elongate member further comprises a housing and a bar, said bar being telescopingly insertable into said housing allowing relative axial movement therewith;

(h) said securing means further comprising a means to releasably secure said bar at a selected point within said housing;

(i) said bar comprises a substantially rectangular cross-section having upper, lower, and side surfaces, and further comprises lengthwise lateral flanges extending from and along said side surfaces;

(j) said housing comprises internal upper and side surfaces, and further comprises lengthwise channels defined in and extending along said side surfaces; and (k) said securing means further comprises a substantially full engagement of said upper and side surfaces of at least a portion of said bar with said internal upper and side surfaces of at least a portion of said housing, respectively, and by a substantially full engagement of a corresponding portion of said flanges with said channels, securing said bar and said housing against a relative rotational movement.

2. An adjustable concrete rod, as defined in claim 1, wherein said securing means further comprises threaded fasteners being insertable through said side walls of said housing and into said lengthwise channels, and bearing against said bar.

3. An adjustable concrete rod, as defined in claim 1, wherein said securing means further comprises at least one pin, said pin being fixedly disposed in said housing and being insertable through a selected one of a plurality of pin ports defined in an external upper surface of said housing and into a selected one of a plurality of pin ports defined in said bar.

4. An adjustable concrete rod, as defined in claim 3, wherein said at least one pin is spring-loaded and biased to insert said pin into said selected one of a plurality of pin ports.

5. An adjustable concrete rod, as defined in claim 1, further comprising a means to adjust vertical spacing of said handles from said lower edge of said elongate member.

6. An adjustable concrete rod, as defined in claim 1, wherein said first handle further comprises:

a vertical plate;

a plurality of pin ports defined in said vertical plate;

an end member fixedly disposed on a proximal end of said bar; and a pin fixedly disposed in said end member, said pin being insertable into a selected one of said plurality of pin ports defined in said vertical plate.

7. An adjustable concrete rod, as defined in claim 6, further comprising:

(a) said pin being is fixedly disposed in said end member;

(b) a spring on said pin; and (c) said spring biasing said pin into said selected one of said plurality of pin ports defined in said vertical plate.

8. An adjustable concrete rod for leveling the surface of uncured concrete, said concrete being disposed within a concrete form, said adjustable concrete rod comprising:

(a) an elongate member;

(b) a lower edge, on said elongate member, for the engagement and leveling of said uncured concrete;

(c) a housing, on said elongate member, comprising:
internal upper and side surfaces; and
lengthwise channels defined in and extending along said side surfaces;

(d) a bar on said elongate member;

(e) said bar being telescopingly insertable into said housing allowing relative axial movement therewith;

(f) said bar comprises a substantially rectangular cross-section having upper, lower, and side surfaces, and further comprises lengthwise lateral flanges extending from and along said side surfaces;

(g) a first handle extending outwardly from a proximal end of said elongate member, (h) a second handle extending outwardly from a distal end of said elongate member, (i) said handles adapted to engage upper edges of a concrete form in which said uncured concrete is poured, (j) said handles being manually graspable to move said elongate member along said surface of said concrete, with said lower edge in contact therewith, while said handles are in engagement with said upper edges of said concrete form;

(k) a securing means, to permit selective lengthwise adjustment of said elongate member, comprising:
a means to releasably secure said bar at a selected point within said housing;
a substantially full engagement of said upper and side surfaces of at least a portion of said bar with said internal upper and side surfaces of at least a portion of said housing, respectively, and by a substantially full engagement of a corresponding portion of said flanges with said channels, securing said bar and said housing against a relative rotational movement;
at least one pin, said pin being fixedly disposed in said housing and being insertable through a selected one of a plurality of pin ports defined in an external upper surface of said housing and into a selected one of a plurality of pin ports defined in said bar; and
threaded fasteners being insertable through said side walls of said housing and into said lengthwise channels, and bearing against said bar; and (l) said at least one pin comprising:
a spring on said pin; and
said spring biasing said pin into said selected one of said plurality of pin ports.

9. An adjustable concrete rod, as defined in claim 8, wherein said first handle further comprises:

(a) a vertical plate;

(b) a plurality of pin ports defined in said vertical plate;

(c) an end member fixedly disposed on a proximal end of said bar; and (d) a pin fixedly disposed in said end member, said pin being insertable into a selected one of said plurality of pin ports defined in said vertical plate.

10. An adjustable concrete rod, as defined in claim 9, further comprising:

(a) said pin being fixedly disposed in said end member;

(b) a spring on said pin; and (c) said spring biasing said pin into said selected one of said plurality of pin ports defined in said vertical plate.

* * * * *